United States Patent [19]

Zimmerman

[11] Patent Number: 4,757,939

[45] Date of Patent: Jul. 19, 1988

[54] CARTON DIVIDER

[75] Inventor: John Zimmerman, Scarborough, Canada

[73] Assignee: Paperboard Industries Corporation, Toronto, Canada

[21] Appl. No.: 115,389

[22] Filed: Nov. 2, 1987

[51] Int. Cl.[4] ..... B65D 5/10

[52] U.S. Cl. ..... 229/120.26; 229/120.27; 206/143

[58] Field of Search ..... 229/120.26, 120.24, 229/120.25, 120.29, 120.37, 120.29; 206/141, 143, 501; 220/94 A

[56] References Cited

U.S. PATENT DOCUMENTS

| | | | |
|---|---|---|---|
| 2,423,332 | 7/1947 | Mayer | 229/120.25 |
| 2,719,650 | 10/1955 | Buttery et al. | 229/120.27 |
| 4,243,138 | 1/1981 | Wilson | 229/120.27 |
| 4,318,470 | 3/1982 | Montealegre | 229/120.29 |
| 4,418,818 | 12/1983 | Stone | 229/120.29 |
| 4,469,222 | 9/1984 | Graser | 206/143 |

*Primary Examiner*—Willis Little

*Attorney, Agent, or Firm*—Fetherstonhaugh & Co.

[57] ABSTRACT

A carton divider formed from an elongated unitary blank which is formed with a plurality of fold lines which extend from its upper edge toward its lower edge in a spaced relationship. The fold lines serve to divide the blank into first, transverse divider panels, a first side wall panel, a second transverse divider panel, a second side wall panel, a third transverse divider panel and a central handle panel. The blank being cut to form a second handle panel and a first glue flap which extends downwardly from the upper edge. The second handle panel has one edge hingedly connected to the second divider panel along one of the fold lines. The second handle panel has a length which matches that of the first handle panel. The first glue flap is hingedly connected to the second handle panel along one of the fold lines. The blank is cut to form a third handle panel and a second glue flap which extends downwardly from the upper edge. The third handle panel has one edge hingedly connected to the central handle panel. The third handle panel has a length which matches that of the first handle panel. The second glue flap is hingedly connected to the third handle panel along a further fold line. The first and third transverse divider panels have a length which is equal to half that of the second divider panel. An adhesive coating is applied to the outer face of the blank in the area of the first handle panel and on the inner face of the blank in the second handle panel, first glue flap, third handle panel and second glue flap, such that when the divider is assembled by folding the blank, it will form two enclosures arranged one on either side of the handle panels.

4 Claims, 4 Drawing Sheets

CARTON DIVIDER

This invention relates to carton dividers. In particular, this invention relates to a carton divider which incorporates a handle and which is designed to be inserted into a carton for the purposes of dividing the carton into six storage compartments arranged three on either side of the handle.

PRIOR ART

A carton divider made from a unitary elongated rectangular shaped blank is disclosed in U.S. Pat. No. 4,583,677 Neese et al dated Apr. 22, 1986. This patent does not, however, make any provision for a handle.

It is an object of the present invention to provide a carton divider formed from a unitary generally rectangular shaped blank which serves to provide divider panels and a strong centrally located handle.

It is a further object of the present invention to provide a divider assembly which can be mounted within a carton such as a beer carton so as to divide the container space into six compartments arranged three on either side of the longitudinal centre line of the container space with the handle panel of the divider located on the longitudinal centre line of the container space and being accessible for use when lifting a carton.

According to one aspect of the present invention there is provided a carton divider comprising;

an elongated unitary blank having an upper edge and a lower edge extending longitudinally thereof, first and second end edges at opposite ends thereof, an inner face and an outer face, said blank being formed with a plurality of fold lines which extend normal to the longitudinal extent of the blank, a first of said fold lines extending from said upper edge toward said lower edge in a spaced relationship with respect to said first edge to form a first handle panel therebetween, a second of said fold lines extending in a spaced relationship with respect to said first fold line to form a first transverse divider panel therebetween, a third of said fold lines extending in a spaced relationship with respect to said second fold line to form a first side wall panel therebetween, a fourth of said fold lines extending in a spaced relationship with respect to said third fold line to form a second transverse divider panel therebetween, a fifth of said fold lines extending in a spaced relationship with respect to said fourth fold line to form a second side wall panel therebetween, a sixth of said fold lines extending in a spaced relationship with respect to said second fold line to form a third transverse divider panel therebetween, and a central handle panel formed between the sixth fold line and the second end edge of the blank, said blank being cut to form a second handle panel and a first glue flap which extend downwardly from said upper edge, said second handle panel having one edge hingedly connected to said second divider panel along a seventh fold line which extends parallel to and is centrally located with between the third and fourth fold lines, said second handle panel having a longitudinal extent from said seventh fold line which matches that of said first handle panel, said first glue flap being hingedly connected to said second handle panel along an eighth fold line which extends parallel to said seventh fold line, said blank beng cut to form a third handle panel and a second glue flap which extend downwardly from said upper edge, said third handle panel having one edge hingedly connected to said central handle panel along said sixth fold line, said third handle panel having a longitudunal extent from said sixth fold line which matches that of said first handle panel, said second glue flap being hingedly connected to said third panel along a ninth fold line which extends parallel to said sixth fold line, said first and third transverse divider panels having a length in the direction of the longitudinal extent of the blank which is equal to half that of the second divider panel, an adhesive coating on said outer face of the blank in the area of said first handle panel and on the inner face of the blank in the area of said second handle panel, first glue flap, third handle panel and second glue flap, such that when said divider is assembled by folding the blank.

The invention will be more clearly understood after reference to the following detailed specification read in conjunction with the drawings wherein FIG. 1 is a plan view of the inner face of a blank which is cut and scored in order to form a plurality of panels and fold lines, FIGS. 2, 3 and 4 are plan views similar to FIG. 1 showing the folding sequence required to assemble the divider.

Figure 1:
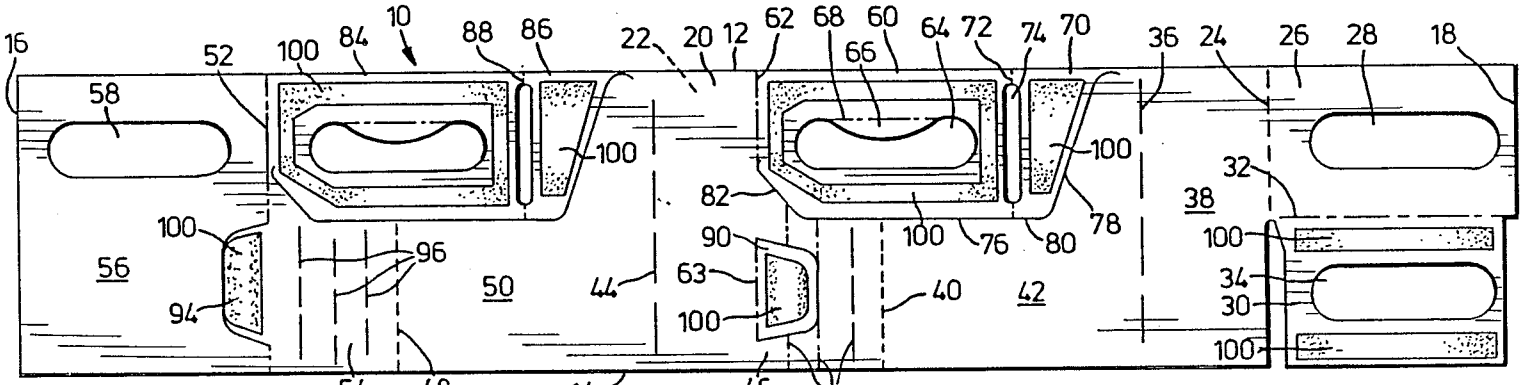

With reference to FIG. 1 of the drawings, the reference numeral 10 refers generally to a blank according to an embodiment of the present invention. The blank 10 has an upper edge 12 and lower edge 14 extending longitudinally thereof. First and second end edges 18 and 16 are located at opposite ends of the blank. The blank 10 also has an inner face 20 and an outer face 22.

The blank 12 is formed with a plurality of fold lines which extend at right angles to the upper and lower edges. A first fold line 24 extends parallel to the first end edge 18. A first handle panel 26 is located between the end edge 18 and fold line 24 and is formed with a hand access passage 28 which opens therethrough. A stiffening handle panel 30 is hingedly connected to the first handle panel 26 along a first horizontal fold line 32 and has a hand access passage 34 formed therein which is aligned with the passage 28 when the panel 30 is folded along the hinge line 32 to locate it in a face-to-face relationship with the first handle panel 26. A second weakened fold line 36 is arranged in a spaced relationship with respect to the first fold line 24 to form a first transverse divided panel 38 therebetween.

A third fold line 40 is arranged in a spaced relationship with respect to the fold line 36 to provide a first side wall panel 42 therebetween. A fourth fold line 44 is spaced from the fold line 40 and serves to form a second transverse divider panel 46 therebetween. A fifth fold line 48 extends parallel to the fold line 44 and serves to form a second side wall panel 50 therebetween. A sixth fold line 52 extends parallel to the fold line 48 and serves to provide a third transverse divider panel 54 therebetween. A central handle panel 56 extends between the sixth fold line 52 and the end edge 16 of the back. A finger access passage 58 is formed in the central handle panel 56.

A second handle panel 60 has one edge hingedly connected to the second divider panel 46 along a seventh fold line 62. The seventh fold line 62 is located centrally between the third fold line 40 and the fourth fold line 44. The second handle panel 60 has an longitudinal extent from the seventh fold line which is equal to the longitudinal extent of the first handle panel. A finger access passage 64 opens through the first handle panel 60. A flap 66 is hingedly connected to the first handle panel 60 along a longitudinally hinge line 68. In use, this flap folds over adjacent edges of the other handle panels and provides a wide gripping surface which avoids contact with exposed edges of the handle panels. A first glue flap 70 is hingedly connected to the first handle panel 60 along hinge line 72. A notch 74 is formed along the hinge line 72 to facilitate the bending of the glue flaps 70 with respect to the second handle panel as the carton blank is erected. The second handle panel and first glue flap are separated from the remainder of the blank along a cut line generally identified by the reference numeral 76 which includes a first length 78 which extends downwardly from the upper edge 12 and is inclined toward the third fold line, a second horizontally extending length 80 which extends to a point adjacent the fold line 62 and a third length 82 which is upwardly inclined toward and terminates at the fold line 62.

A third handle panel 84 is hingedly connected to the central handle panel 56 along the hinge line 52 and is shaped and proportioned to be substantially identical to the second handle panel and will not therefore be described in detail. Similarly, a second glue flap panel 86 is hingedly attached to the third handle panel 84 along hinge panel lines 88.

The blank 10 is also cut to provide a third glue flap 90 which is struck from the divider panel 46 and connected thereto along the hinge line 63 which is aligned with the hinge line 62. A fourth glue flap 94 is struck from the central handle panel 56 and is connected to the transverse divider panel 54.

A plurality of weakened fold lines 96 are formed in the divider panel 54 and extend in a spaced parallel relationship with respect to the fold lines 48 and 52. These weakened fold lines 96 serve to facilitate buckling of the divider panel 54 in use to permit the divider assembly to be inserted into an undersized storage compartment. Similar weakened fold lines 98 are formed on the divider panel 46 between the fold lines 40 and 62 and also serve to facilitate bucking of the divider panel portion formed therebetween.

Figure 3:
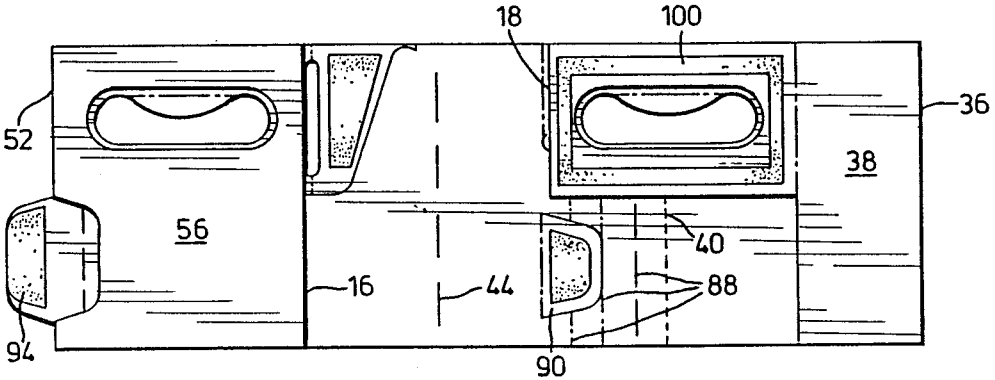

An adhesive coating 100 (FIG. 3) is applied to the outer face of the first handle panel 26. Similar adhesive coatings 100 are applied to the inner face of the blank in the area of the second handle panel 60, first glue flap 70, third handle panel 84, second glue flap 86, stiffening handle panel 30, third glue flap 90 and fourth glue flap 94.

To assemble the divider the stiffening handle 30 is folded along the fold line 32 to be located in a face-to-face relationship with respect to the first handle panel 26.

Figure 2:
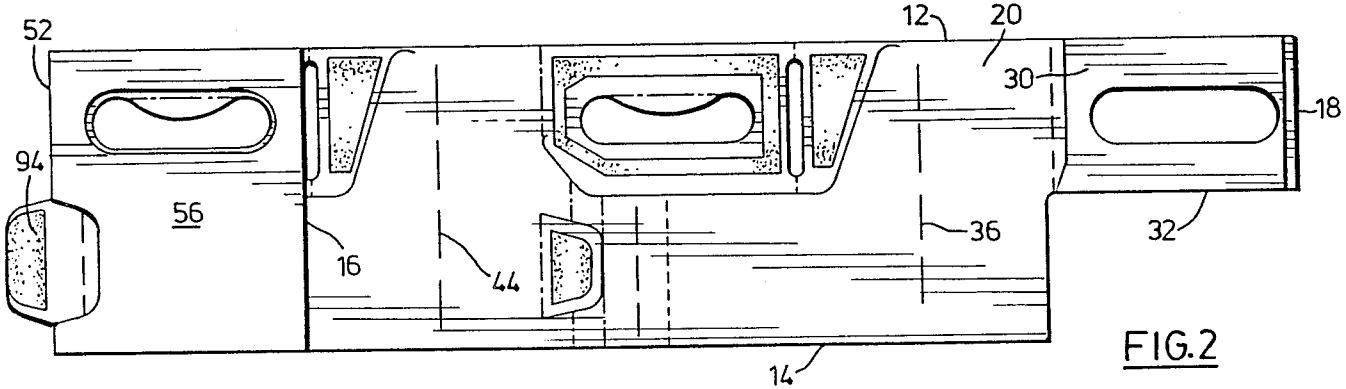

The blank is then folded along the second fold line 36 (FIG. 3) to locate the first handle panel 26 in a position overlying the second handle panel 60 with the stiffening handle panel 32 located therebetween and adhesively secured thereto. As a result of the folding along the third fold line 36, the first glue flap 70 is located in a face-to-face relationship with respect to the first transverse divider panel 38 and is adhesively secured thereto. Blank is also folded along the sixth fold line 52 to locate the central handle panel 56 in a face-to-face relationship with respect to the third handle panel 84 to be secured thereto. It will be noted that the fourth glue flap 94 (FIG. 2) does not fold with respect to the divider panel 54 when the central handle panel is folded along the fold line 52.

Figure 4:
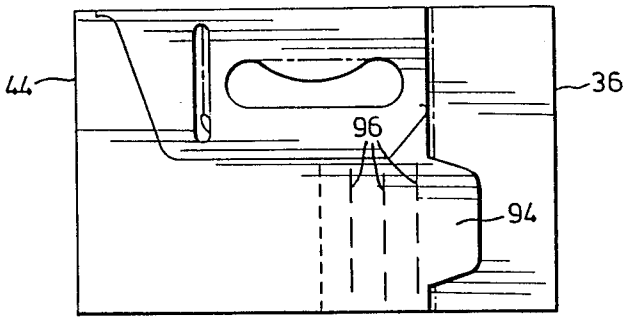

The blank is then folded along the fourth fold line 44 (FIG. 4) to locate the outer face of the central handle panel 56 in a face-to-face relationship with respect to the outer face of the first handle panel to be adhesively secured thereto.

As a result of the folding along the fourth fold line 44, the second glue flap 86 is located in a face-to-face relationship with respect to a portion of the divider panel 46 and it is adhesively secured thereto. Similarly, the third glue flap 90 is located in a face-to-face relationship with respect to a portion of the outer face of the central panel 56 and is adhesively secured thereto. The fourth glue flap 94 is also located in a face-to-face relationship with respect to a portion of the outer face of the divider panel 38 and is adhesively secured thereto.

Figure 5:
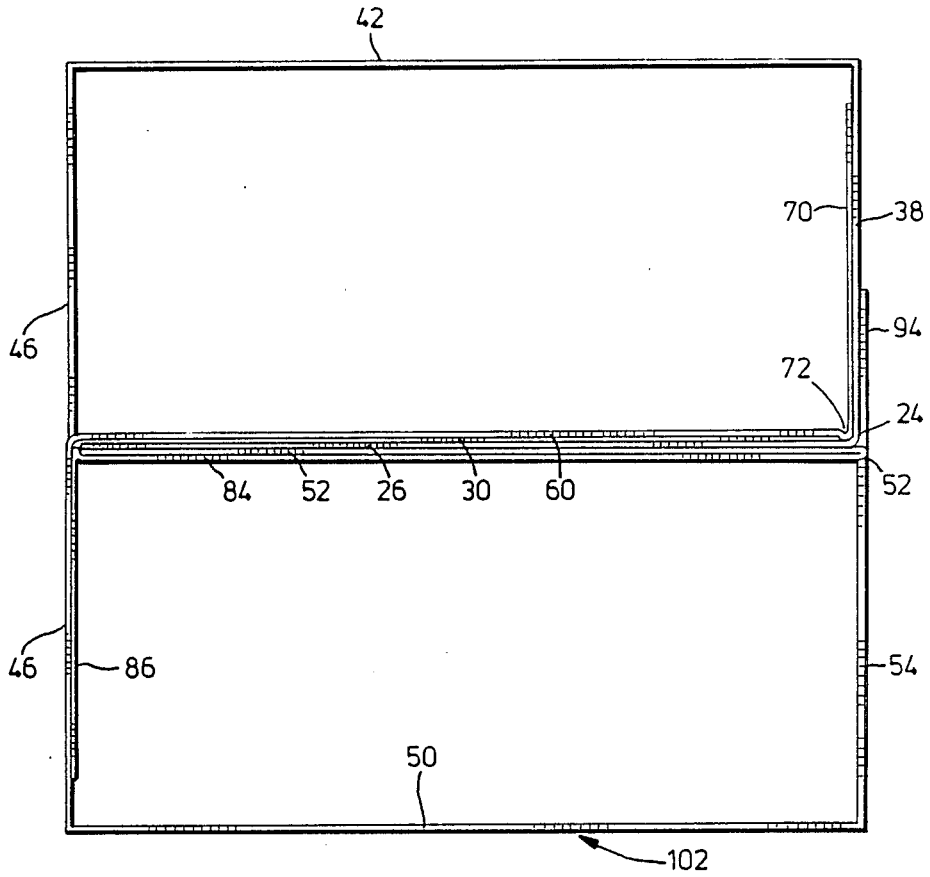
FIG. 5 is a plan view showing the divider in its open configuration.

In order to erect the carton divider to an open configuration, it is merely necessary to push the edges of the blank located along the fold lines 36 and 44 toward one another and this, in turn, causes the divider walls to pivot with respect to the handle panels so as to project transversely therefrom to assume the position shown in FIG. 5 of the drawings.

Figure 6:
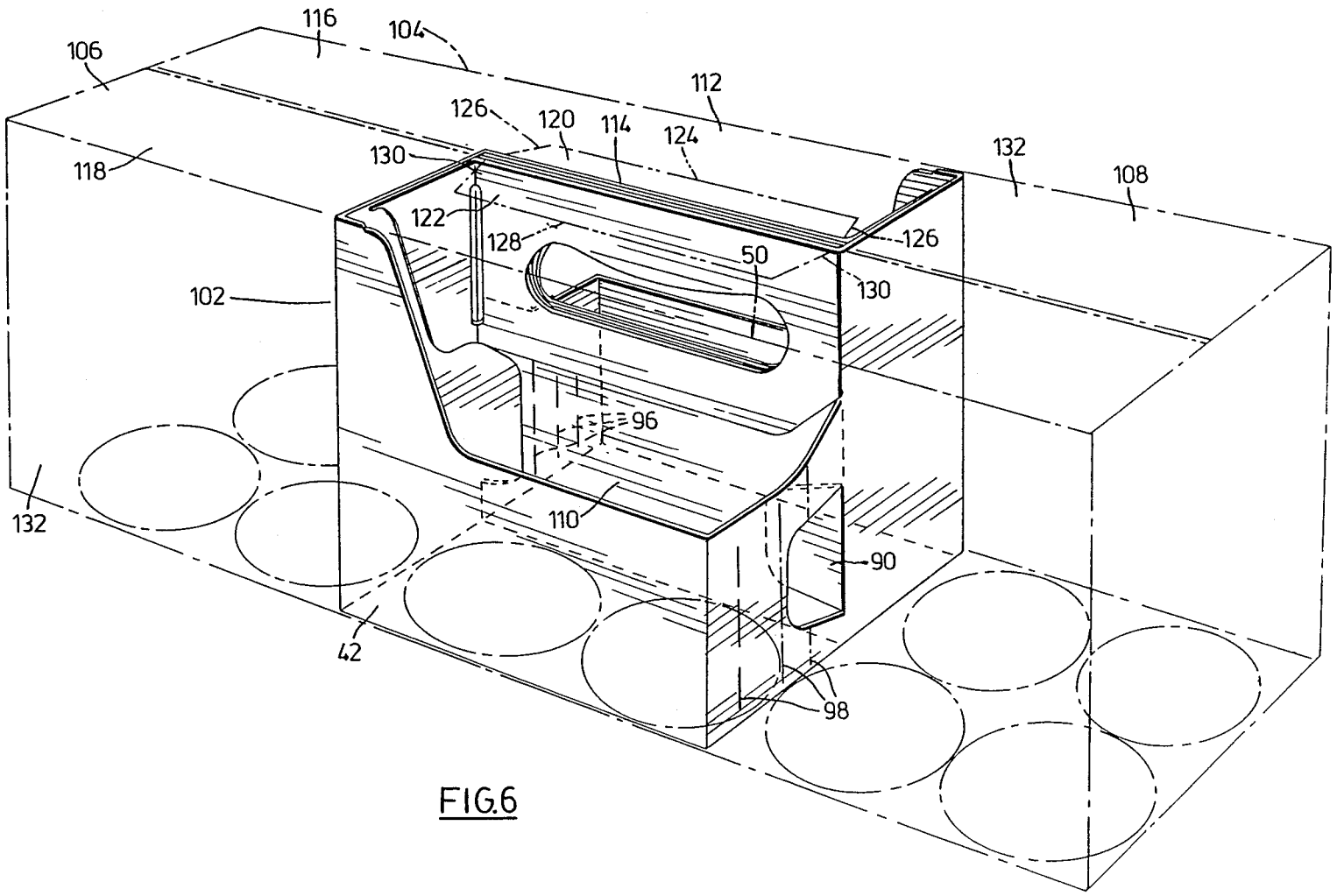
FIG. 6 shows the divider located in a carton in its operable position.

As shown in FIG. 6 of the drawings, when the divider 102 is located in a carton 104 of the type in which twelve beer bottles are commonly sold, the container space within the carton 102 is subdivided into four compartments which includes end compartments 106 and 108 which accommodate four bottles and central compartments 110 and 112 which each accommodate two bottles. Thee compartments 110 and 112 are separated from one another by a composite handle panel which is generally identified by the reference numeral 114.

The carton 104 has top closure flaps 116 and 118 formed with access flaps 120 and 122. The access flap 120 is hingedly connected to the panel 116 along the hinge line 124 and is separated therefrom along the weakened tear lines 126. The flap 122 is hingedly connected along the hinge line 128 and is separated from the top closure panel 118 by weakened tear lines 130. The flap 122 is hingedly connected along the hinge line 128 to the panel 106 and is severable along the weakened tear lines 130. To gain access to the handle, it is merely necessary to fold the flaps 120 and 122 downwardly by bending along the hinge lines 124 ad 126. The user is then able to grasp the handle in a conventional manner. The handle will remain in position with respect to the divider 120. The divider assembly 102 is secured in the carton 108 by means of an adhesive located at the interface between the side walls 132 and the longitudinal divider panels 42 and 52 respectively.

Because of the fact that bottles such as beer bottles vary in diameter, it is necessary to construct the cartons 104 in different widths. A variation in width is a relatively small variation and it has been found that one divider can be accommodated in cartons of different widths merely by forcing the oversize divider into the compartment and allowiwng the divider walls which are formed with the weakened fold lines 96 and 98 to buckle about these folds lines to reduce the effective width of the transverse divider panels at each end of the divider unit 102.

From the foregoing, it will be apparent that the present invention provides a simple and inexpensive divider assembly which incorporates a strong handle structure and which is capable of fitting within cartons of various widths.

I claim:

1. A carton divider comprising;

an elongated unitary blank having; an upper edge and a lower edge extending longitudinally thereof, first and second end edges at opposite ends thereof, an inner face and an outer face, said blank being formed with a plurality of fold lines which extend normal to the longitudinal extent of the blank, a first of said fold lines extending from said upper edge toward said lower edge in a spaced relationship with respect to said first edge to form a first handle panel therebetween, a second of said fold lines extending in a spaced relationship with respect to said first fold line to form a first transverse divider panel therebetween, a third of said fold lines extending in a spaced relationship with respect to said second fold line to form a first side wall panel therebetween, a fourth of said fold lines extending in a spaced relationship with respect to said third fold line to form a second transverse divider panel therebetween, a fifth of said fold lines extending in a spaced relationship with respect to said fourth fold line to form a second side wall panel therebetween, a sixth of said fold lines extending in a spaced relationship with respect to said second fold line to form a third transeverse divider panel therebetween, and a central handle panel formed between the sixth fold line and the second end edge of the blank, said blank being cut to form a second handle panel and a first glue flap which extend downwardly from said upper edge, said second handle panel having one edge hingedly connected to said second divider panel along a seventh fold line which extends parallel to and is centrally located with between the third and fourth fold lines, said second handle panel having a longitudinal extent from said seventh fold line which matches that of said first handle panel, said first glue flap being hingedly connected to said second handle panel along an eighth fold line which extends parallel to said seventh fold line, said blank being cut to form a third handle panel and a second glue flap which extend downwardly from said upper edge, said third handle panel having one edge hingedly connected to said central handle panel along said sixth fold line, said third handle panel having a longitudinal extent from said sixth fold line which matches that of said first handle panel, said second glue flap being hingedly connected to said third handle panel along a ninth fold line which extends parallel to said sixth fold line, said first and third transverse divider panels having a length in the direction of the longitudinal extent of the blank which is equal to half that of the second divider panel, an adhesive coating on said outer face of the blank in the area of said first handle panel and on the inner face of the blank in the area of said second handle panel, first glue flap, third handle panel and second glue flap, such that when said divider is assembled by folding the blank;

(a) along the second fold line, the first handle panel will be secured in an overlying relationship with respect to the second handle panel and the first glue flap w ill be secured in an overlying relationship with respect to the first divider panel, (b) along the sixth fold line, the central handle panel will be secured in an overlying relationship with respect to the third handle panel, (c) along the fourth fold line, the first and second handle panels will be secured in an overlying relationship with respect to the central and third handle panels and the second glue flap will be secured in an overlying relationship with respect to the third divider panel, said divider being erected to form two enclosures arranged one on either side of the handle panels by simultaneously unfolding the assembled blank along the second and fourth fold lines while folding the blank along the first, third, fourth, fifth, sixth and seventh fold lines.

2. A carton divider as claimed in claim 1, wherein said blank is formed with a fourth handle panel hingedly connected to the first handle panel along a first longitudinally extending hinge line, and wherein an adhesive coating is applied to the inner face of the blank in the area of the fourth handle panel, said blank being folded along said first horizontal hinge line to secure the fourth handle panel in overlying relationship with respect to the first handle panel.

3. A carton divider as claimed in claim 1, wherein said blank is formed with a third glue flap w hich is struck from the second transverse divider panel and is hingedly connected thereto along an eleventh of said fold lines which is aligned with said seventh fold line and wherein an adhesive coating is applied to the inner face of the blank in the area of said third glue flap such that when said blank is folded along said fourth fold line the third glue flap is secured in overlying relationship with respect to the outer face of said central handle panel.

4. A carton divider as claimed in claim 3 wherein said blank is formed with a fourth glue flap which is struck from the central handle panel and is connected to and projects longitudinally from the fourth divider panel and wherein an adhesive coating is applied to the inner face of the blank in the area of said fourth glue flap such that when said blank is folded along said fourth fold line the fourth glue flap is secured in overlying relationship with respect to the outer face of said first transverse divider panel.

* * * * *